US007543568B1

(12) United States Patent
Prior

(10) Patent No.: US 7,543,568 B1
(45) Date of Patent: Jun. 9, 2009

(54) FUEL PRESSURE AMPLIFIER FOR IMPROVED CRANKING PERFORMANCE

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/031,003

(22) Filed: Feb. 14, 2008

(51) Int. Cl.
*F02M 69/46* (2006.01)
*F02M 69/50* (2006.01)

(52) U.S. Cl. ..... 123/456

(58) Field of Classification Search ..... 123/456, 123/447, 446, 495, 468, 469; 417/225, 226, 417/227

See application file for complete search history.

(56) References Cited

U.S. PATENT DOCUMENTS 4,601,642 A * 7/1986 Andrews ..... 417/225
6,497,217 B2 * 12/2002 Kojima ..... 123/456
6,786,205 B2 * 9/2004 Stuhldreher et al. ..... 123/495

* cited by examiner

*Primary Examiner*—Mahmoud Gimie

(57) ABSTRACT

A fuel system may include an auxiliary fuel pump in communication with a fuel source, a fuel pressure amplifier in communication with the fuel pump, a first chamber defining a first fluid volume in communication with the auxiliary fuel pump, a second chamber defining a second fluid volume, and a fuel injector in communication with the second fluid volume. The fuel pressure amplifier may include a piston mechanism having a first side defining a first surface area and a second side defining a second surface area that is less than the first surface area. The first fluid volume may apply a force to the first side of the piston mechanism that is greater than a second force to the second side resulting in displacement of the piston mechanism. The fuel injector may provide a pressurized fuel supply to an engine based on the displacement of the piston mechanism.

20 Claims, 4 Drawing Sheets

FUEL PRESSURE AMPLIFIER FOR IMPROVED CRANKING PERFORMANCE

FIELD

The present disclosure relates to engine fuel systems, and more specifically to engine fuel pressure enhancement.

BACKGROUND

The statements in this section merely provide background information related to the present disclosure and may not constitute prior art.

Engine fuel systems may include engine driven fuel pumps that are driven by a rotating engine component. The fuel pump may be indirectly driven by the engine crankshaft through engagement with a camshaft. During engine start conditions, the first several revolutions of the engine crankshaft may be at a speed that is less than a speed required to produce a desired fuel pressure from the fuel pump. This is particularly true in fuel systems such as direct injection fuel systems where fuel at high pressure is injected directly into an engine cylinder.

SUMMARY

A fuel system may include an auxiliary fuel pump, a fuel pressure amplifier, a first chamber defining a first fluid volume, a second chamber defining a second fluid volume, and a fuel injector. The auxiliary fuel pump may be in communication with a fuel source. The fuel pressure amplifier may be in communication with the fuel pump and may include a piston mechanism. The piston mechanism may include a first side having a first surface area and a second side that is generally opposite the first side and having a second surface area that is less than the first surface area. The first fluid volume may be in communication with the auxiliary fuel pump and may apply a first fluid pressure to the first surface area based on a pressurized fuel source provided by the auxiliary fuel pump to create a first force on the piston mechanism. The second fluid volume may apply a second fluid pressure to the second surface area to create a second force on the piston mechanism that is less than the first force resulting in displacement of the piston mechanism. The fuel injector may be in communication with the second fluid volume and may provide a pressurized fuel supply to an engine based on the displacement of the piston mechanism.

An engine assembly may include an engine block defining a cylinder, a fuel injector in communication with the cylinder to selectively provide a fuel flow to the cylinder, an auxiliary fuel pump in communication with a fuel source, a fuel pressure amplifier, and first and second chambers defining first and second fluid volumes. The fuel pressure amplifier may be in communication with the auxiliary fuel pump and may include a piston mechanism. The piston mechanism may include a first side having a first surface area and a second side that is generally opposite the first side and having a second surface area that is less than the first surface area. The first fluid volume may be in communication with the auxiliary fuel pump and may apply a first fluid pressure to the first surface area based on a pressurized fuel source provided by the auxiliary fuel pump to create a first force on the piston mechanism. The second fluid volume may be in communication with the fuel injector and may apply a second fluid pressure to the second surface area to create a second force on the piston mechanism that is less than the first force resulting in displacement of the piston mechanism.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
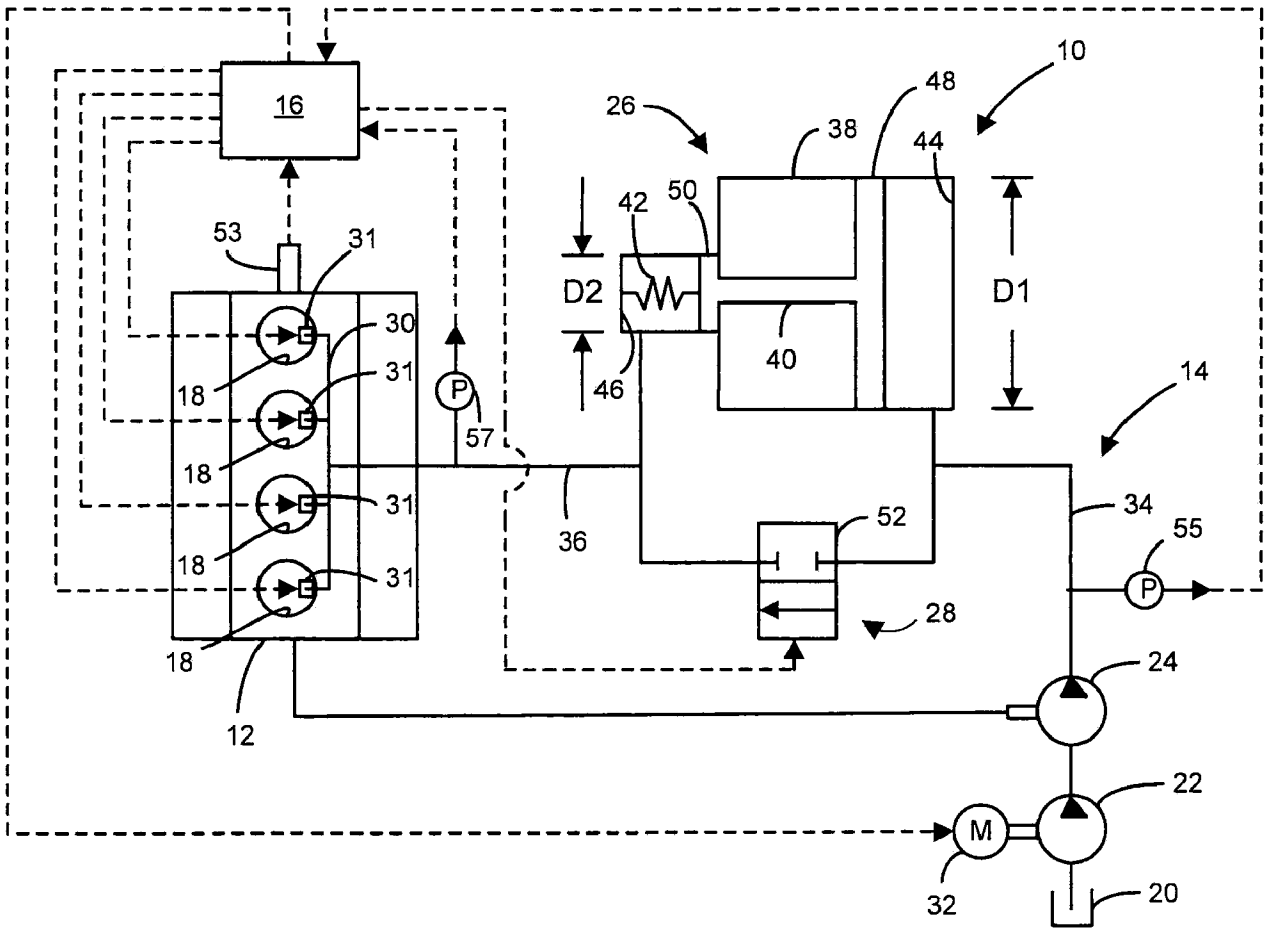
FIG. 1 is a schematic illustration of an engine assembly in a first operating mode according to the present disclosure.

The following description is merely exemplary in nature and is not intended to limit the present disclosure, application, or uses. It should be understood that throughout the drawings, corresponding reference numerals indicate like or corresponding parts and features.

Figure 2:
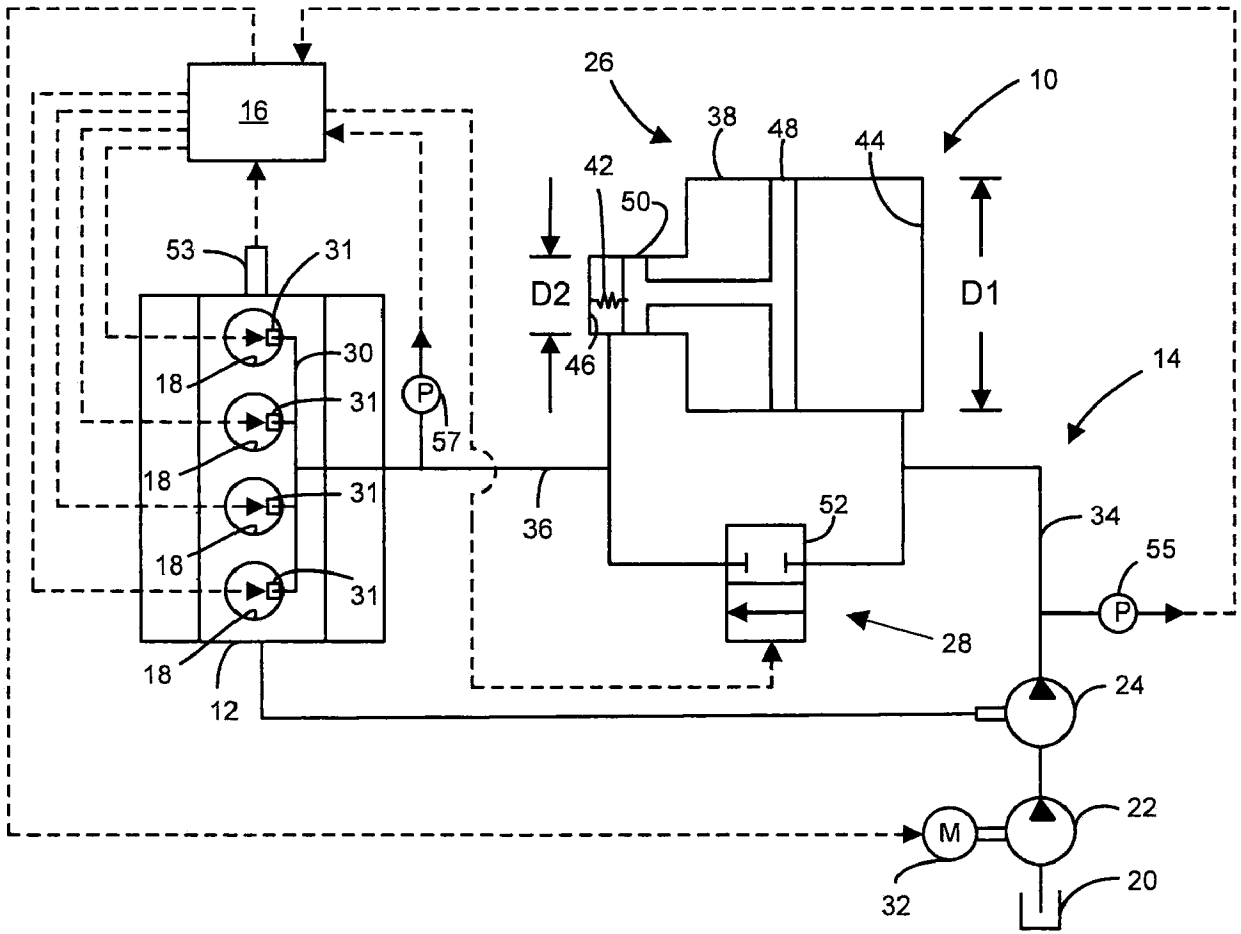
FIG. 2 is a schematic illustration of the engine assembly of FIG. 1 in a second operating mode.
Figure 3:
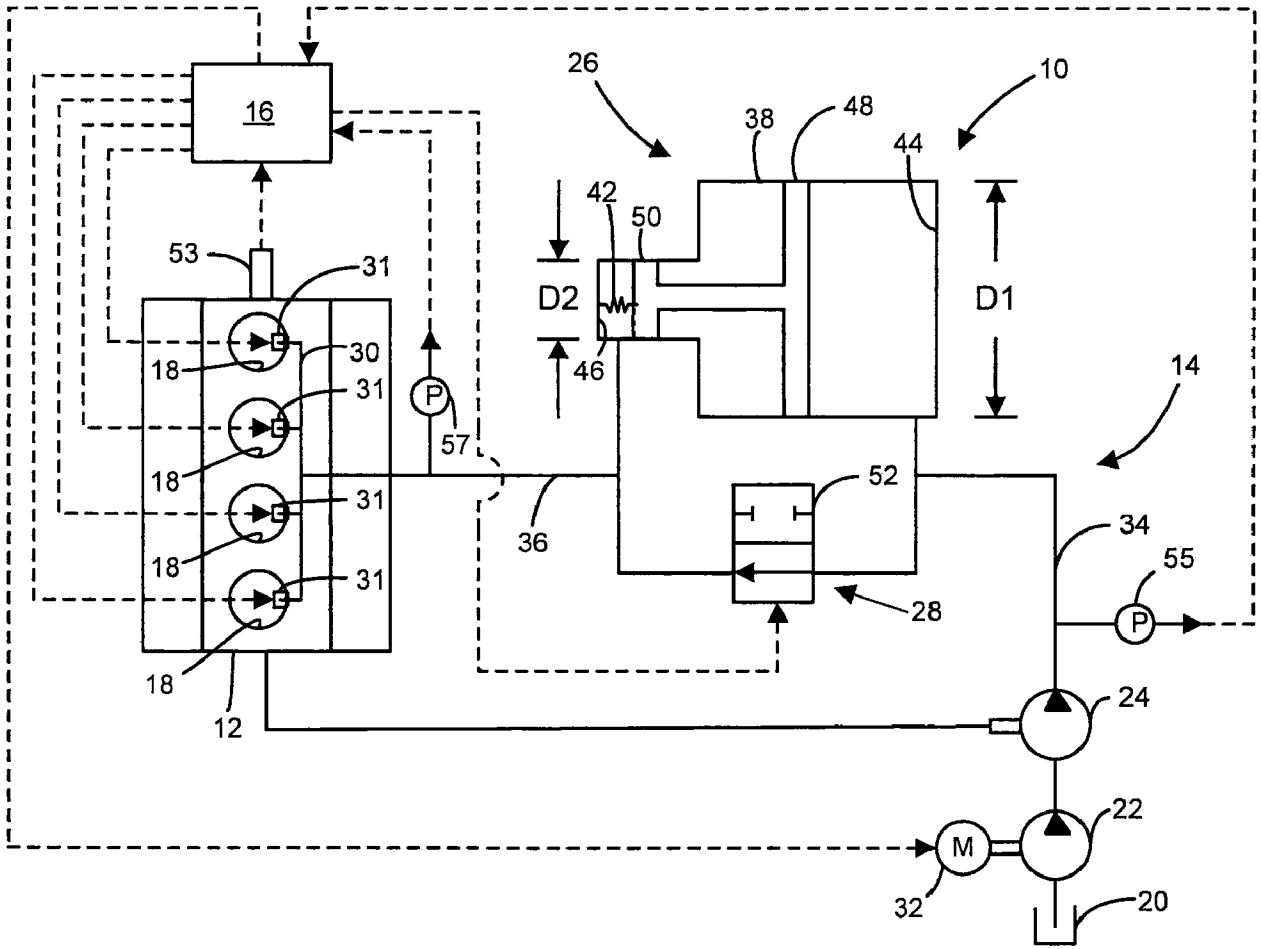
FIG. 3 is a schematic illustration of the engine assembly of FIG. 1 in a third operating mode.

Referring to FIGS. 1-3, an exemplary engine assembly 10 is schematically illustrated. The engine assembly 10 may include an engine 12 in communication with a fuel system 14 and a control module 16. In the example shown, the engine 12 may include an engine block that defines a plurality of cylinders 18 in communication with the fuel system 14.

The fuel system 14 may include a fuel tank 20, first and second fuel pumps 22, 24, a pressure amplifier system 26, a control valve system 28, a fuel rail 30, fuel injectors 31, and first and second conduits 34, 36. The first fuel pump 22 may include an auxiliary fuel pump, for example, a lift pump, that is driven by an electric motor 32 and may be in fluid communication with fuel within the fuel tank 20. The first fuel pump 22 may be in fluid communication with the second fuel pump 24.

The second fuel pump 24 may include a variety of types of pumps that can be driven by the engine 12, including but not limited to gerotor pumps, gear pumps, and reciprocating pumps. More specifically, the second fuel pump 24 may be rotationally driven by the engine 12. The rotational drive may include engagement with a rotationally driven component of the engine 12, such as a camshaft (not shown) or any other member having rotation powered by the engine 12. The second fuel pump 24 may be in fluid communication with the pressure amplifier system 26 and the control valve system 28 via the first conduit 34.

The pressure amplifier system 26 may include a housing 38, a piston 40, and a biasing member 42. The housing 38 may include first and second chambers 44, 46 that are isolated from one another. The first chamber 44 may be in fluid communication with the first conduit 34 and the second chamber 46 may be in fluid communication with the second conduit 36.

The piston 40 may include first and second ends 48, 50. The first end 48 may have a first diameter (D1) that is greater than a second diameter (D2) of the second end 50. Therefore, the first end 48 may have a first surface area (A1) that is greater than a second surface area (A2) of the second end 50. The first and second ends 48, 50 of the piston 40 may be sized for a desired pressurization of fuel within the fuel system 14 during an engine start condition. The biasing member 42 may include a compression spring and may initially bias the piston 40 toward the first chamber 44 to the position shown in FIG. 1 at an engine start condition.

Figure 4:
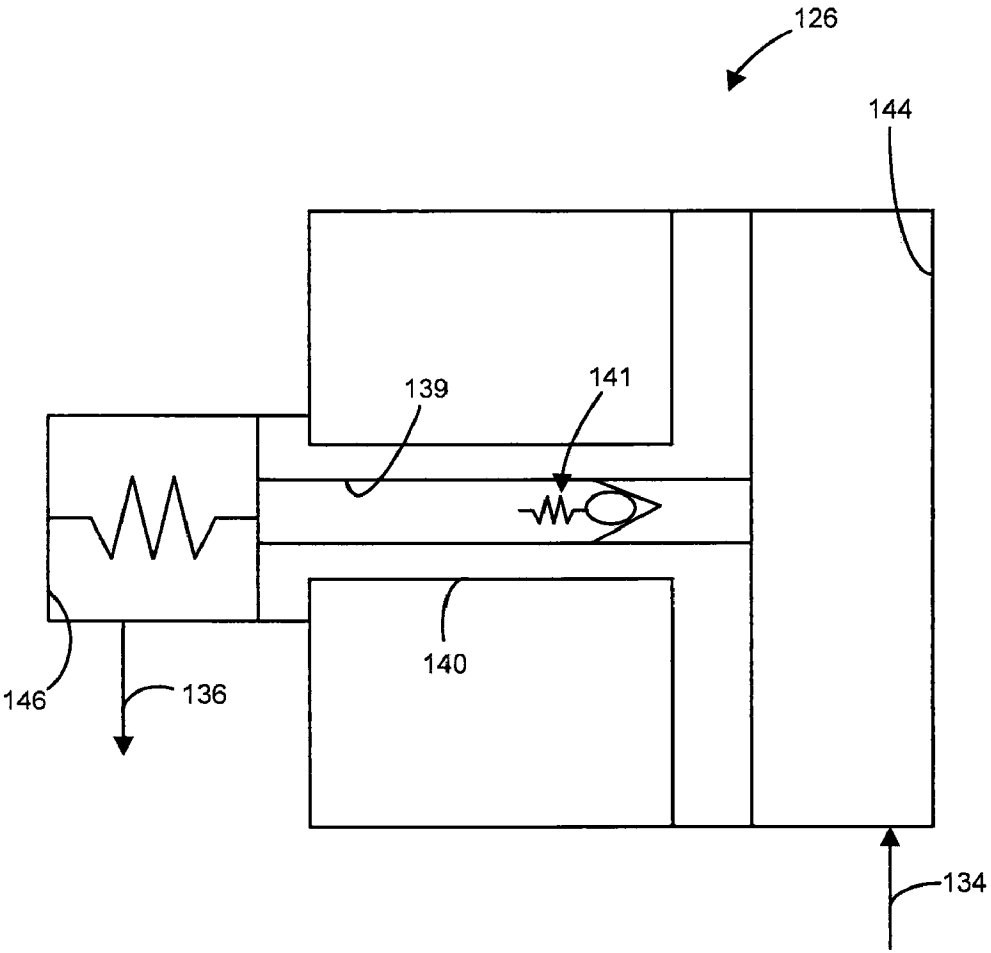
FIG. 4 is a schematic illustration of an alternate fuel pressure amplifier according to the present disclosure.

Alternatively, as seen in FIG. 4, a pressure amplifier system 126 may be incorporated into the engine assembly 10 in place of the pressure amplifier system 26. The pressure amplifier system 126 may be generally similar to the pressure amplifier system 26 with the exception of the piston 140. The piston 140 may include a passage 139 having a valve 141 disposed therein to selectively provide communication between the first and second chambers 144, 146. For example, the valve 141 may include a check valve that is calibrated to open when a fluid pressure within the first chamber 144 exceeds a fluid pressure within the second chamber 146. The first chamber 144 may be in fluid communication with a first conduit 134 that is similar to the first conduit 34 and the second chamber 146 may be in fluid communication with a second conduit 136 that is similar to the second conduit 36.

Referring back to FIGS. 1-3, the control valve system 28 may include a solenoid valve that is in communication with the control module 16. The control valve system 28 may include a valve member 52 that is displaceable between a first position (seen in FIGS. 1 and 2) and a second position (seen in FIG. 3). When the valve member 52 is in the first position the first and second conduits 34, 36 may be generally isolated form one another. When the valve member 52 is in the second position, the first and second conduits 34, 36 may be in communication with one another.

The fuel rail 30 may be in communication with the second conduit 36. The fuel injectors 31 may be in fluid communication with the fuel rail 30 and may also be in communication with the control module 16 for commanded injection of fuel into the cylinders 18. The control module 16 may selectively operate the first fuel pump 22, actuate the control valve system 28, and control operation of the fuel injectors 31 to adjust fuel delivery at an engine start condition. The control module 16 may additionally be in communication with an engine speed sensor 53 to determine an operating speed of the engine 12 and first and second pressure sensors 55, 57 to determine a fuel pressure provided by the second pump 24 and a fuel pressure supplied to the fuel rail 30, and therefore the fuel injectors 31. The control module 16 may place the valve member 52 in the second position when the fuel pressure measured by the first pressure sensor 55 indicates a pump out pressure of the second pump 24 that is greater than a predetermined pressure and/or when the engine speed measured by the engine speed sensor 53 is greater than a predetermined engine speed.

In the present example, an engine start condition may correspond to a condition where the first and second conduits 34, 36 and the first and second chambers 44, 46 are filled with fuel and the valve member 52 is in the first (or closed) position. The first chamber 44 may define a first volume (V1) and the second chamber 46 may define a second volume (V2). The first fuel pump 22 may be powered by the electric motor 32 and may begin pressurizing fuel within the first conduit 34 and the first chamber 44 since the first conduit 34 and the first chamber 44 are isolated from the second fluid conduit 36 and the second chamber 46. The second fuel pump 24 may be driven by the engine 12 and may additionally pressurize fuel within the first conduit 34 and the first chamber 44. As the pressure increases within the first chamber 44, the piston 40 may be displaced toward the second chamber 46 (as seen in FIG. 2), pressurizing the fuel within the second conduit 36 and the second chamber 46. The fuel injectors 31 may be selectively opened to inject fuel into the cylinder 18 based on the pressurized fuel provided by the piston 40 during the engine start condition.

The first and second surface areas (A1, A2), the first and second volumes (V1, V2) and the stroke of the piston 40 may be sized to provide a desired fuel pressure to the fuel injectors 31 over a desired time. The duration and/or frequency of opening the fuel injectors 31 may be adjusted by the control module 16 based on the pressure measurement from the pressure sensor 57 and/or based on an engine speed measurement from the engine speed sensor 53. For example, the fuel system 14 may include a direct injection fuel system. In direct injection fuel systems, relatively high fuel pressures are typically provided to the fuel injectors 31. For example, fuel pressures in the range of 10,000 to 15,000 kilopascal (kPa) may be appropriate for a desired operation of the fuel injectors 31.

The first fuel pump 22 may provide significantly less than the pressure needed for direct injection applications. For example, the first fuel pump 22 may provide fuel pressures of 100 to 400 kPa. During the engine start condition the first several rotations of the crankshaft may be at a rotational speed that is less than a speed needed to power the second pump 24 to achieve a desired operating pressure (for example, 10,000-15,000 kPa). The pressure amplifier system 26 may be used to increase the pressure provided to the fuel injectors 31. If the pressure amplifier system 26 is unable to provide a desired fuel pressure, the duration and/or frequency of opening the fuel injectors 31 may be increased to provide a desired amount of fuel to the cylinders 18.

Based on the displacement of the piston 40, the fuel within the second conduit 36 and the second chamber 46, and therefore the fuel provided to the fuel injectors 31, may be at least ten times the fuel pressure within the first conduit 34 and the first chamber 44, and more specifically greater than fifty times the fuel pressure within the first conduit 34 and the first chamber 44. The piston 40 may be displaced to create this pressure differential due to the difference between the first and second surface areas (A1, A2). The force (F1) applied to the first end 48 of the piston 40 may generally be equal to the pressure (P1) within the first chamber 44 multiplied by the first surface area (A1) of the first end 48 (F1=P1*A1). The force (F2) applied to the second end 50 of the piston 40 may generally be equal to the pressure (P2) within the second chamber 46 multiplied by the second surface area (A2) of the second end 50 (F2=P2*A2).

Therefore, the first surface area (A1) may be at least ten times the second surface area (A2), and more specifically greater than fifty times the second surface area (A2) to provide the desired fuel pressure amplification. It is understood that a variety of alternate surface area and pressure relationships may be used to provide a desired fuel pressure amplification. Once the second fuel pump 24 has reached a desired operating speed and/or once the first and second forces (F1, F2) are approximately equal to one another, the valve member 52 may move to the second position (seen in FIG. 3) to provide communication between the first and second conduits 34, 36.

What is claimed is:

1. A fuel system comprising:

an auxiliary fuel pump in communication with a fuel source;

a fuel pressure amplifier in communication with the auxiliary fuel pump, the fuel pressure amplifier including a piston mechanism having a first side defining a first surface area and a second side generally opposite the first side and defining a second surface area that is less than the first surface area;

a first chamber in communication with the auxiliary fuel pump and defining a first fluid volume applying a first fluid pressure to the first surface area based on a pressurized fuel source provided by the auxiliary fuel pump to create a first force on the piston mechanism;

a second chamber defining a second fluid volume applying a second fluid pressure to the second surface area to create a second force on the piston mechanism that is less than the first force resulting in displacement of the piston mechanism;

a fuel injector in communication with the second fluid volume that provides a pressurized fuel supply to an engine based on the displacement of the piston mechanism; and a control valve system located between the auxiliary fuel pump and the fuel injector and including a valve mechanism displaceable between an open position and a closed position, the auxiliary fuel pump being in communication with the fuel injector when the valve mechanism is in the open position and being isolated from fluid communication with the fuel injector by the valve mechanism when the valve mechanism is in the closed position.

2. The fuel system of claim 1, wherein the first fluid volume is isolated from the second fluid volume during displacement of the piston mechanism, the displacement of the piston mechanism increasing the pressure within the second chamber to a third fluid pressure.

3. The fuel system of claim 2, wherein the third fluid pressure is at least 10 times greater than the first fluid pressure.

4. The fuel system of claim 1, further comprising a primary fuel pump that is driven by the engine and located between the auxiliary fuel pump and the first chamber, the primary fuel pump being in communication with the auxiliary fuel pump and the first chamber, the auxiliary fuel pump being driven by an electric motor and providing a fuel flow to the primary fuel pump and the primary fuel pump providing a pressurized fuel flow to the first chamber.

5. The fuel system of claim 4, wherein the valve mechanism is located between the primary fuel pump and the fuel injector, the primary fuel pump being isolated from communication with the fuel injector when the valve mechanism is in the closed position, the piston mechanism providing a pressurized fuel supply to the injector from the second fluid volume when the valve mechanism is in the closed position until the primary fuel pump reaches one of a predetermined pump out pressure and a predetermined driven speed.

6. The fuel system of claim 5, wherein the valve mechanism is in communication with the first and second fluid volumes, the valve mechanism preventing communication between the first and second fluid volumes when in the closed position while the primary fuel pump operates below the one of the predetermined pump out pressure and the predetermined driven speed.

7. The fuel system of claim 6, wherein the valve mechanism is in the open position when the primary fuel pump is operated above the one of the predetermined pump out pressure and the predetermined driven speed to provide communication between the primary fuel pump and the fuel injector.

8. The fuel system of claim 7, wherein the valve mechanism includes a mechanical valve that opens based on the predetermined pump out pressure from the primary fuel pump.

9. The fuel system of claim 7, wherein the valve mechanism includes a solenoid operated valve that opens based on the one of the predetermined pump out pressure and the predetermined driven speed of the primary fuel pump.

10. The fuel system of claim 1, wherein the first surface area is at least 10 times greater than the second surface area.

11. An engine assembly comprising:

an engine block defining a cylinder;

a fuel injector in communication with the cylinder to selectively provide a fuel flow to the cylinder;

an auxiliary fuel pump in communication with a fuel source;

a fuel pressure amplifier in communication with the auxiliary fuel pump, the fuel pressure amplifier including a piston mechanism having a first side defining a first surface area and a second side generally opposite the first side and defining a second surface area that is less than the first surface area;

a first chamber in communication with the auxiliary fuel pump and defining a first fluid volume applying a first fluid pressure to the first surface area based on a pressurized fuel source provided by the auxiliary fuel pump to create a first force on the piston mechanism;

a second chamber defining a second fluid volume in communication with the fuel injector and applying a second fluid pressure to the second surface area to create a second force on the piston mechanism that is less than the first force resulting in displacement of the piston mechanism; and a control valve system located between the auxiliary fuel pump and the fuel injector and including a valve mechanism displaceable between an open position and a closed position, the auxiliary fuel pump being in communication with the fuel injector when the valve mechanism is in the open position and being isolated from fluid communication with the fuel injector by the valve mechanism when the valve mechanism is in the closed position.

12. The engine assembly of claim 11, wherein the first fluid volume is isolated from the second fluid volume during displacement of the piston mechanism, the displacement of the piston mechanism increasing the pressure within the second chamber to a third fluid pressure.

13. The engine assembly of claim 12, wherein the third fluid pressure is at least 10 times greater than the first fluid pressure.

14. The engine assembly of claim 11, further comprising a primary fuel pump that is driven by the engine and located between the auxiliary fuel pump and the first chamber, the primary fuel pump being in communication with the auxiliary fuel pump and the first chamber, the auxiliary fuel pump being driven by an electric motor and providing a fuel flow to the primary fuel pump and the primary fuel pump providing a pressurized fuel flow to the first chamber.

15. The engine assembly of claim 14, wherein the valve mechanism is located between the primary fuel pump and the fuel injector, the primary fuel pump being isolated from communication with the fuel injector when the valve mechanism is in the closed position, the piston mechanism providing a pressurized fuel supply to the injector from the second fluid volume when the valve mechanism is in the closed position until the primary fuel pump reaches one of a predetermined pump out pressure and a predetermined driven speed.

16. The engine assembly of claim 15, wherein the valve mechanism is in communication with the first and second fluid volumes, the valve mechanism preventing communication between the first and second fluid volumes when in the closed position while the primary fuel pump operates below the one of the predetermined pump out pressure and the predetermined driven speed.

17. The engine assembly of claim 16, wherein the valve mechanism is in the open position when the primary fuel pump is operated above the one of the predetermined pump out pressure and the predetermined driven speed to provide communication between the primary fuel pump and the fuel injector.

18. The engine assembly of claim 17, wherein the valve mechanism includes a solenoid operated valve that opens based on the one of the predetermined pump out pressure and the predetermined driven speed of the primary fuel pump.

19. The engine assembly of claim 11, wherein the first surface area is at least 10 times greater than the second surface area.

20. The engine assembly of claim 11, wherein the fuel injector injects a fuel flow directly into the cylinder.

* * * * *